United States Patent [19]

Wise et al.

[11] Patent Number: 4,667,750

[45] Date of Patent: May 26, 1987

[54] VIBRATORY EARTH PENETRATOR WITH SYNCHRONIZED AIR LANCE CONTROL

[75] Inventors: Boyd A. Wise, Hopewell; Stanley M. Miller, Bridgewater, both of N.J.

[73] Assignee: Gas Research Institute, Chicago, Ill.

[21] Appl. No.: 758,470

[22] Filed: Jul. 24, 1985

[51] Int. Cl.[4] ..... E21B 7/18; E21B 7/24

[52] U.S. Cl. ..... 175/55; 175/213; 175/215; 175/317; 175/393; 175/424

[58] Field of Search ..... 175/55, 56, 67, 71, 175/215, 231, 317, 324, 393, 422, 213; 173/49, 75, 77; 405/248

[56] References Cited

U.S. PATENT DOCUMENTS

| | | | |
|---|---|---|---|
| 2,743,586 | 5/1956 | Berther et al. | 61/73 |
| 3,216,512 | 11/1965 | Grable | 175/71 |
| 3,216,514 | 11/1965 | Nelson | 175/317 |
| 3,851,490 | 12/1974 | Matowshita | 61/53.74 |
| 4,266,619 | 5/1981 | Bodine | 175/55 |
| 4,548,281 | 10/1985 | Bodine | 175/55 |

FOREIGN PATENT DOCUMENTS

| | | | |
|---|---|---|---|
| 595477 | 2/1978 | U.S.S.R. | 175/393 |

*Primary Examiner*—James A. Leppink
*Assistant Examiner*—Hoang C. Dang
*Attorney, Agent, or Firm*—Richard C. Woodbridge

[57] ABSTRACT

A vibratory earth penetrator employing a high pressure air distributor and an oscillating mechanism has the ability to dig down to underground utilities and contact those utilities without damaging them. The invention includes a hollow elongated tube having a plurality of air lances at the bottom end thereof. The air is preferably distributed to the air lances by an air distributor in a criss-cross sequence. An oscillating eccentric weight is synchronized with the air distributor to enhance the digging effect of the device. The penetrator is supported by a boom which includes an automatic tension device for providing sufficient upward force to keep the penetrator in the vertical attitude while allowing the weight of the penetrator to provide enough force to permit the device to dig into the ground. Since the digging action is accompanied by very little downward force, it is possible to contact underground utilities without hurting them.

26 Claims, 17 Drawing Figures

132
48
124
46
36
50
123
72
74
10
56
86
122
114
172
174
144
116
112
110
146
120
118
106
126
130
101
148
100
154
39
162
96
162
94

"FIRING SEQUENCE"

VIBRATORY EARTH PENETRATOR WITH SYNCHRONIZED AIR LANCE CONTROL

BACKGROUND OF THE INVENTION

1. Field of the Invention

A virbratory earth penetrator employing high pressure air controlled by an air distributor mechanism and synchronized with an eccentric mechanical oscillator is employed to gently penetrate soil without damaging the underground utilities with which it comes into contact.

2. Description of the Prior Art

The prior art literature reveals a number of patents which employ compressed gases, such as high pressure air, to assist in the digging of a hole. For example, U.S. Pat. No. 3,916,634 discloses an apparatus for digging holes in rather soft, sandy soil by forcing compressed air down an annular sleeve, thereby causing the soil at the bottom of the sleeve to be eroded and forced up and out of an inner passageway. U.S. Pat. No. 3,825,082 is a divisional of U.S. Pat. No. 3,916,634 and is therefore relevant for the same reasons. The following patents were cited in the prosecution of U.S. Pat. No. 3,916,634 and therefore may have relevance of their own: U.S. Pat. Nos. 1,173,355; 1,762,012; 1,853,397; 2,019,719; 2,786,652; 3,020,965; 3,274,782 and 3,674,100. Of the foregoing group U.S. Pat. No. 2,786,652 is notable in that it discusses the use of pressurized gas to erode material at the bottom of a pipe string. The drill includes a mechanism which causes it to rotate in a conventional fashion and a means for controlling the pressure of the gas at the bottom of the well bore. U.S. Pat. No. 1,762,012 discloses the use of compressed air to dislodge materials at the bottom of a well. Also, U.S. Pat. No. 3,674,100 discloses a combined compressed air and water drilling apparatus. Lastly, U.S. Pat. No. 2,019,719 discloses a "Terrestial Excavation" device that employs both air and water as eroding fluids. A plurality of orifices located at regular intervals around the periphery of the bottom of the drill bit act to improve the operation of the overall device. The other patents cited in U.S. Pat. No. 3,916,634 appear to be significantly less relevant.

U.S. Pat. No. 3,419,092 discloses a "Well Drilling Method" which does not necessarily require a rotating drill or bit, but instead employs air or other gas to assist in drilling operations at off-shore locations. Similarly, U.S. Pat. No. 3,851,490 discloses the use of a combination of air and water to drill a hole for setting a pile. U.S. Pat. No. 2,167,393 discloses another process in which a combination of a fluid and liquid can be used to improve the efficiency of a drill.

A number of prior art patents disclose the use of a liquid, such as water for erosion purposes rather than air. For example, U.S. Pat. No. 3,638,741 discloses an hydraulic "Post Hole Borer". Similar devices using water or similar liquids for drilling holes are described in U.S. Pat. Nos. 118,369; 789,324; 1,659,826; 2,605,090 and 3,938,600.

U.S. Pat. No. 3,920,090 is notable for its disclosure of a "Control Method and Apparatus for Pressure, Vacuum or Pressure-Vacuum Circulation in Drilling System". That patent discloses the use of compressed air and vacuum to remove earth at the bottom of a well hole, and also discloses the use of a device to apply upward tension on the drill.

The prior art also discloses isolated instances of the use of a vibrating mechanism to assist with an earth penetrator. For example, U.S. Pat. No. 2,743,585 describes a variety of methods for inducing vibrations in piles by means of unbalanced weights.

U.S Pat. No. 4,266,619 is of interest in that it describes a "Down Hole Cycloidal Drill Drive" which causes the drill bit at the end of a bore hole to precess. An eccentric weight causes a portion of the drill and stem assembly to precess or roll against the wall of the bore hole in a cycloidal manner and in forceable engagement with the bore hole wall to cause rotation of the drill stem about its own axis. U.S. Pat. No. 3,212,344 describes an "Apparatus Producing Oscillatory Movement of a Shaft" which includes two out-of-balance weights rotating in opposite directions with respect to each other. U.S. Pat. No. 2,229,912 describes a "Method and Apparatus for Displacing Penetrable Material" which comprehends the use of a captive "out-of-balance" weight for producing oscillations. Similarly, a number of patents discuss a method referred to as "Sonic" drilling. See for example, U.S. Pat. Nos. 3,256,789 and 3,360,056. According to another technique, oscillations may be set up along the entire length of the pipe string causing the string to oscillate as a whole. See for example, the eccentric orbiting elongated mass described in U.S. Pat. No. 4,271,915. Also, note the use of an elongated oscillatorv device is described in U.S. Pat. No. 3,049,185.

The prior art further discloses some devices in which the vibration of a drilling element is related to the use of the application of air or other materials. Note, for example, U.S. Pat. No. 3,076,513 that discloses a device including an eccentric drive mechanism that helps settle a bit into a hole. In addition, means are provided for forcing fluid into the hole through orifices. Similarly, U.S. Pat. No. 2,340,959 discloses a "vibrating mechanism" and the use of "acids and oils" for the purpose of assisting in the drilling operation. U.S. Pat. No. 2,360,803 discloses the use of an eccentric weight in the context of a drill that employs a liquid or paste to expedite the drilling process. U.S. Pat. No. 3,280,925 discloses the use of air or water in the context of a percussive drilling device. Similarly, U.S. Pat. No. 3,292,719 discloses a "Drill Bit" equipped with roller cutters which also uses a liquid or gas to expedite the drilling process. Also, U.S. Pat. No. 3,416,617 discloses the use of roller bits and circulating fluid to help erode and remove the soil from the bottom of a well.

Lastly, there appear to be a number of prior art patents related to automatic tensioning devices. Several of those are found in the context of off-shore, floating well drilling platforms. Note for example, U.S. Pat. No. 4,268,013 entitled "Crane Motion Compensator" in which a mechanism is described including a master pressure cylinder which is automatically controlled to displace a sheave to keep a constant displacement between a crane and a loading dock. U.S. Pat. No. 3,891,038 discloses a similar device including a piston and two pulleys. U.S. Pat. No. 3,151,686 discloses a "Hydraulic Weight Control and Compensating Apparatus" which includes a piston and a pair of pulleys designed to maintain a constant tension on a drill string. The structure disclosed in U.S. Pat. No. 3,158,206 is similar to that in U.S. Pat. No. 3,151,686 and further includes an unusual sensor mechanism to control the flow of hydraulic fluid to a master cylinder. U.S. Pat. No. 4,272,059 entitled "Riser Tensioner System" employs a pair of cylinders each having an individual sheave associated therewith. Lastly, U.S. Pat. No.

1,935,105 discloses another tensioning mechanism in which a hydraulic cylinder controls the tension exerted on a drill bit.

Insofar as understood, none of the prior art described above teaches or suggests a penetrating device in which the discharge of compressed gases is synchronized with an oscillating mechanism to improve penetrability. Moreover, the combination of air and oscillation with this invention's special tensioning mechanism appears to be novel in the context of prior art devices.

SUMMARY OF THE INVENTION

Briefly described the invention comprises a vibratory earth penetrator in which high pressure air is synchronized with an oscillating mechanism to improve the earth boring characteristics of the device. According to the preferred embodiment of the invention, a long hollow tube is equipped with fifteen high pressure air lances at the bottom end thereof for eroding soil ahead of the penetrator. The individual air lances are arranged in three sets of five with two sets, i.e. ten lances, arranged around the exterior periphery of the digging end of the tube and an additional five air lances located inwardly of the periphery of the penetrator. A vacuum source is attached to the hollow interior cavity to withdraw the loosened earth from the device. An hydraulic motor drives an eccentric mass rotatablv mounted around the tube causing the tube to precess in the hole. The drive motor is also connected via a shaft to an air distributor mechanism located near the digging end of the penetrator. The air distributor mechanism selectively delivers high pressure air to individual air lances in each of the three groups of five. The air distributor is synchronized with the oscillating eccentric mass in such a way as to cause each individual air lance to be set firmly in the earth so as to give each air blast its maximum effect.

The penetrator is supported by a cable attached to a boom typicallv mounted on a truck. The cable passes over two pulleys attached to a hydraulic cylinder. The hydraulic pressure in the cylinder is controlled so as to maintain a given upward tension on the penetrator. It is desirable to have just enough tension on the penetrator to keep it upright. For example, it is preferred to keep the absolute down force below 600 lbs. The automatic tensioning device applies approximately 200 lbs. to keep the device upright, thereby limiting the total downward force to 400–500 lbs. In so doing the maximum downward force exertable by the device is rarely enough to damage underground utilities.

These and other features of the invention will be more fully understood by reference to the following drawings:

DETAILED DESCRIPTION OF THE PREFERRED EMBODIMENT

During the course of this description like numbers will be used to describe like elements that appear in the different figures illustrating the invention.

Figure 1:
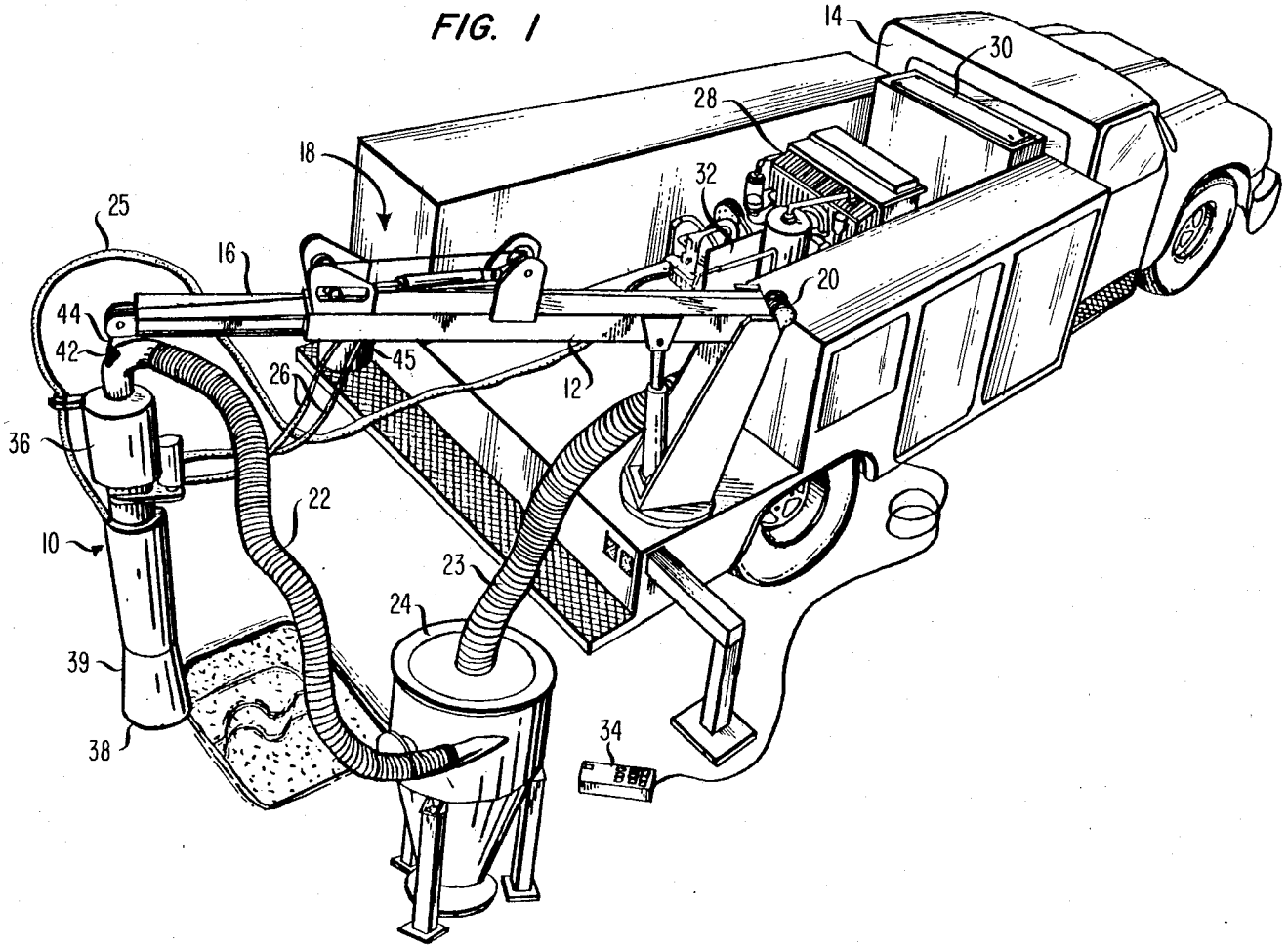
FIG. 1 is a perspective view of the earth penetrator apparatus in the field as shown mounted on a truck and supported by a boom.

FIG. 1 illustrates an earth penetrator 10 according to the preferred embodiment as supported by a boom 12 mounted on a truck 14. A cable 16 is attached through a tensioning mechanism 18 to a cable take-up mechanism 20. The interior passageway 186 of earth penetrator 10 is connected through a vacuum line 22 to an earth receiving cyclone separator 24. Pressurized air is delivered through a flexible air supply line 25 from an hydraulically driven air compressor unit 32. Hydraulic pressure is provided by one of two hydraulic pumps which are attached in a conventional way through a split drive shaft connected to the diesel motor of truck 14. Details of the hydraulic system are disclosed in the schematic diagram of FIG. 9. Hydraulic fluid is provided from a large reservoir 39 to the two pumps. The two main hydraulic pumps are in tandem—both driven from a single drive shaft. This provides easy use of a split-shaft PTO to drive either the main pumps or the truck wheels.

Each pump is controlled bv its own load-sensing hydraulic servo control so that pump flow can be controlled by the operator at a remote position. The pre-set value of maximum pressure will prevent, on a priority basis, any pump flow that would cause pump pressure in excess of the set value.

A separate hydraulic system is driven by a PTO on the truck transmission. This system is primarily for the hydraulic crane swing, extend and dump. It is also used for a cable tension control and for activation of truck outriggers.

Hydraulic fluid delivered bv one of the pumps drives hvdraulic motor 28 which in turn drives the air compressor unit 32. Air compressor unit 32 in turn provides the compressed air supplied to hose 25. Hydraulic fluid is also supplied directly to the drive motor 72 of the eccentric mass unit 36 by flexible hydraulic lines 26. The boom 12 and other moving parts of the earth penetrator 10 are operable through a hand held control unit 34. In general the use of hydraulic pumps and motors to drive air compressors and vacuum systems on a truck is relatively well known to those of ordinary skill in the art and is not claimed to be part of the present invention.

The purpose of the earth penetrator 10 is to dig holes 40 in the earth without damaging underground utilities. The hole 40 is typically round and reflects the circular geometry of the digging end or mouth 38 of the earth penetrator 10. By placing a group of round holes together it is possible to dig a trench, or a square, or any other configuration into the earth. Earth penetrator 10 includes a lifting ring 42 on the top end thereof for attachment by a hook 44 at the end of cable 16. The earth penetrator 10 shown in FIG. 1 is illustrated in the operative mode. When the earth digging operation is complete, the penetrator 10 is unhooked from cable 16 and stored in socket 45 for easy transportation.

Figure 2:
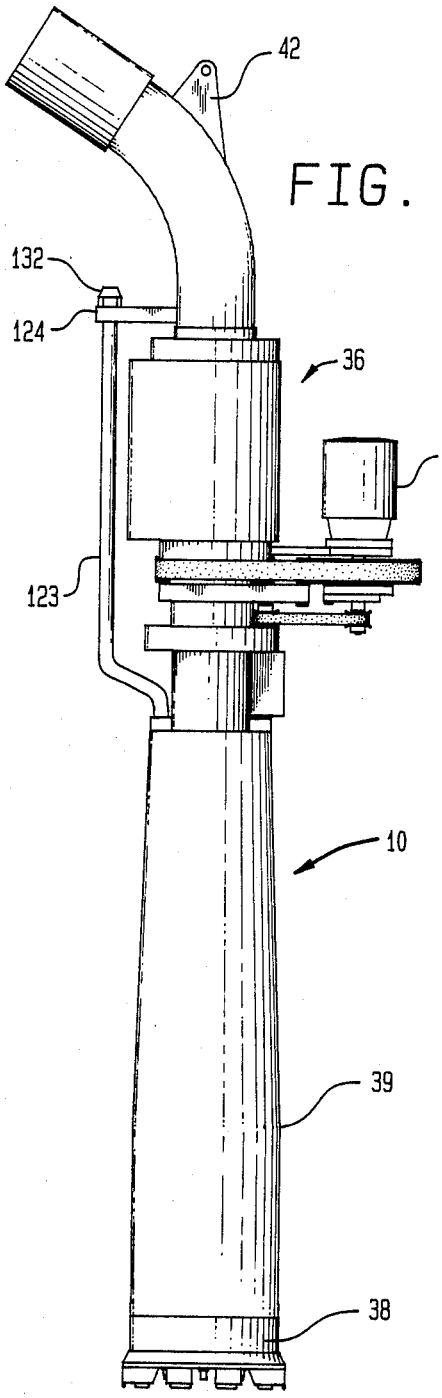
FIG. 2 is a front exterior view of the earth penetrator apparatus.
Figure 3:
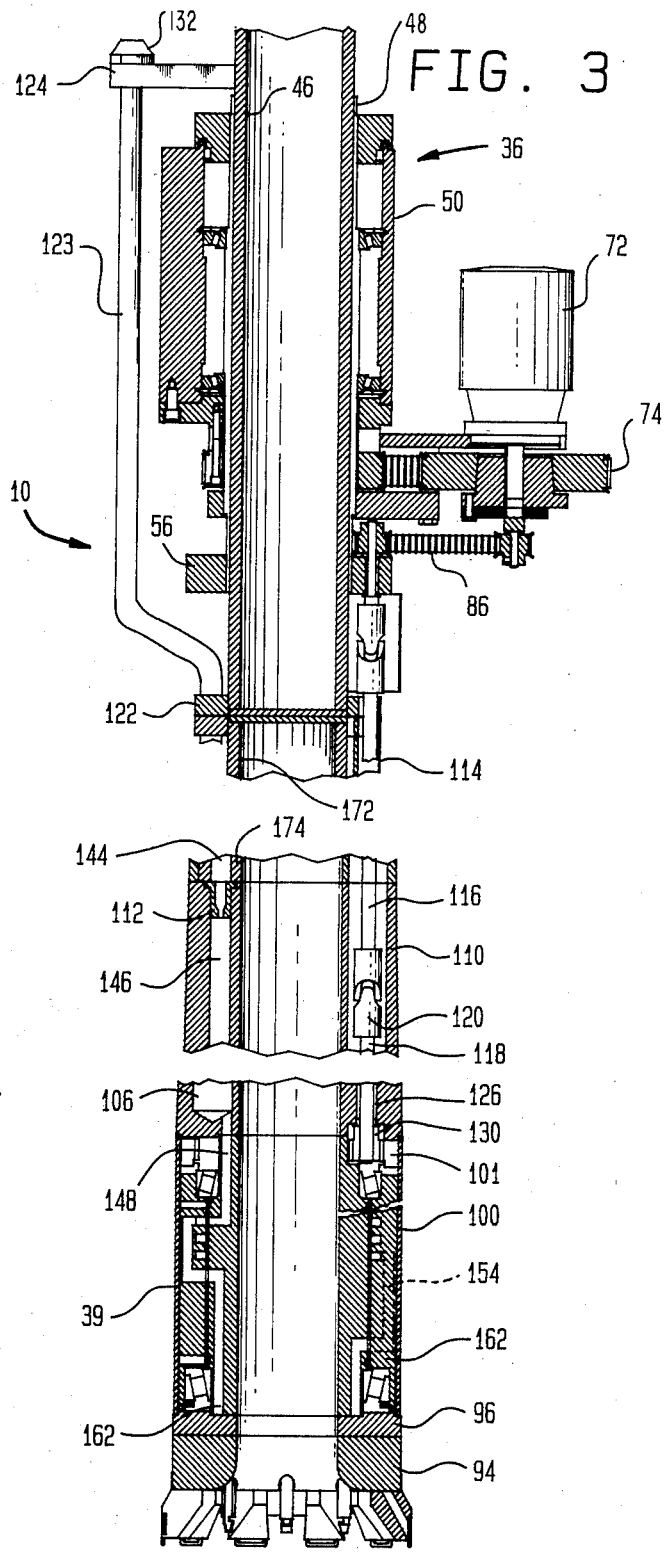
FIG. 3 is a cross-sectional view of the entire earth penetrator apparatus.

FIG. 2 is a front exterior view of the earth penetrator 10 shown in the vertical position. FIG. 3 is a vertical cross-sectional view of the earth penetrator 10 as shown in FIG. 2. There are two especially important sections of the earth penetrator 10, namely, the eccentric mass unit 36 located near the top and the digging end 38 which includes the air distributor section 39.

Figure 4A:
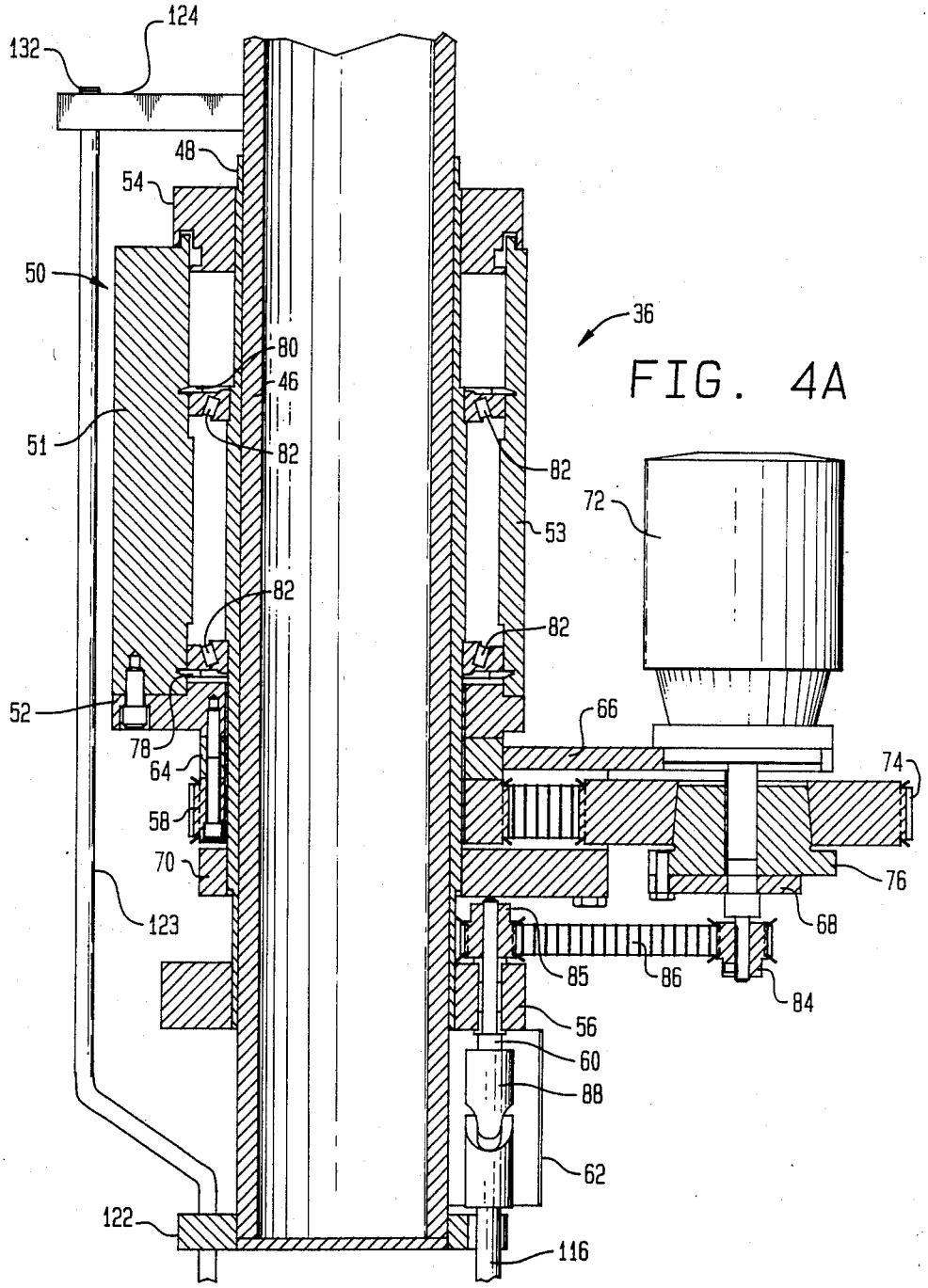
FIG. 4A is a vertical cross-sectional detail view of the eccentric mass unit.
Figure 4B:
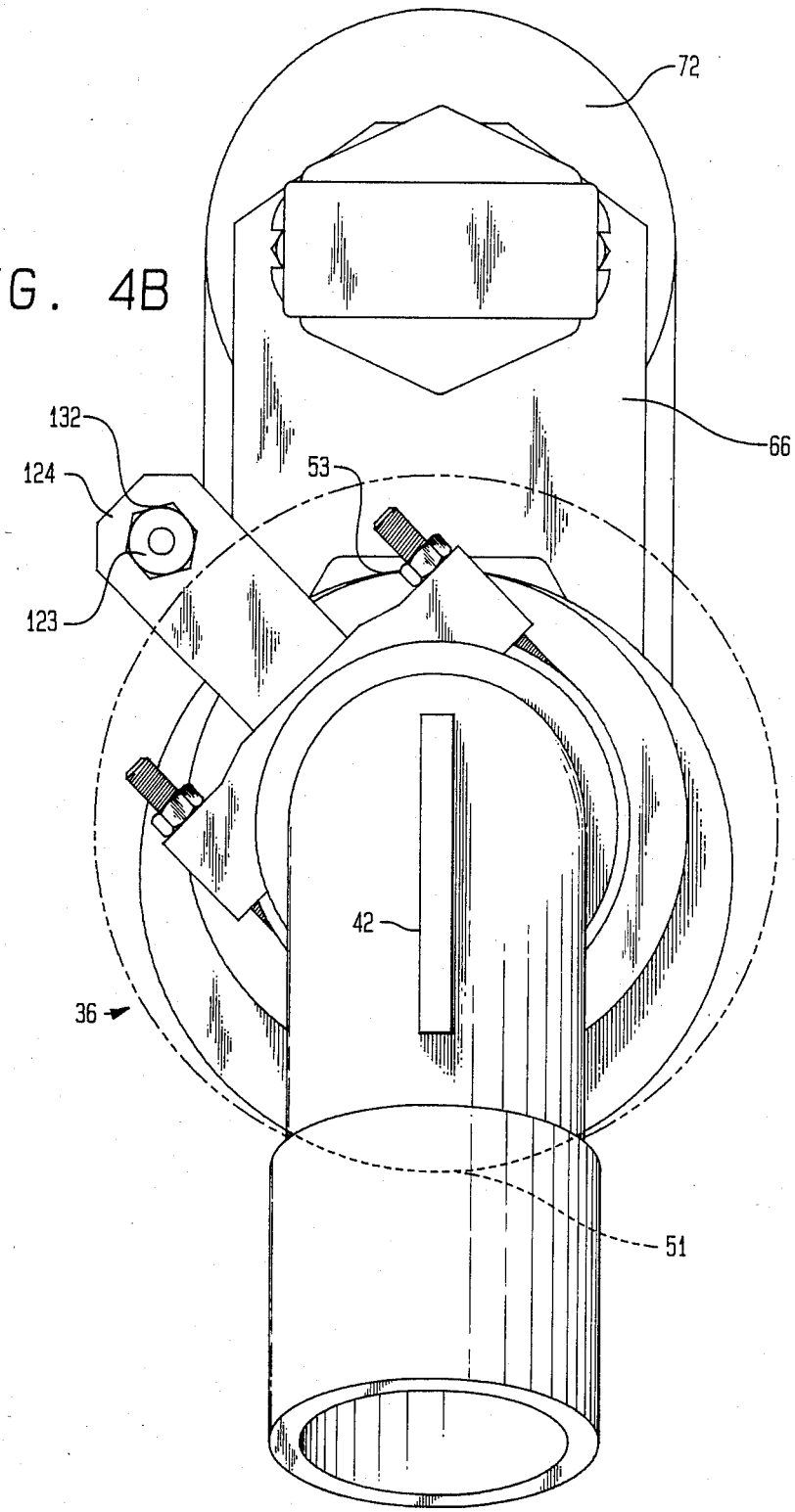
FIG. 4B is a top plan view of the eccentric mass unit.

The eccentric mass unit 36 is illustrated in vertical cross-sectional detail in FIG. 4A and in a top plan view in FIG. 4B. Eccentric mass unit 36 includes an outer tube 48 which surrounds the inner working tube 46 of the earth penetrator 10. An eccentrically mounted mass 50 is driven by hydraulic motor 72 in a circular path thereby causing the top of the inner working tube 46 to orbit about the center-line of the working tube. Eccentric mass 50 comprises a cylindrical weight having an off-center, eccentric hole drilled through the length thereof. This causes mass 50 to have a heavy side 51 and a lighter side 53. Eccentric mass 50 is protected from dirt and corrosive materials by an upper eccentric cap 54 and a lower eccentric cap 52. A set of upper and lower tapered roller bearings 82 support the eccentric mass 50 so that it can rotate about the axis of the inner working tube 46. The lower set of tapered roller bearings 82 are held in place by a beveled retaining ring 78. Similarly the upper set of tapered roller bearings 82 are held in place by a retaining ring 80. Bolts passing through spacer sleeve 64 connect the upper eccentric mass section 50 to a positively driven pulley 58.

A large eccentric motion occurs at the top of the working tube 46 while a small eccentric motion occurs at the bottom 38 of the working tube. The net effect is a tilting motion such that all of the down force is applied to first one lance 90 and then the next, each in succession. The locally-applied force is high enough to cause penetration of a single air lance 90 into a buried firing position—although it is far less than the force needed to penetrate the formation if equal stress were applied to every segment of the digging head. As an example, one lance 90 might require 500 lbs. down force to penetrate into a firing position, whereas 5,000 lbs. would be needed to load ten lances 90 at once.

Hydraulic motor 72 is mounted on outer sleeve 64 by a spacer and bracket 66. The drive shaft of hydraulic motor 72 is positively attached to another timing belt pulley 76 which is held in place by a sheave adaptor 68. Ribbed timing belt 74 positively connects the drive pulley 76 to the driven pulley 58. Motor bracket clamp 70 helps to hold bracket 66 and the eccentric mass 50 in the correct relative positions.

A second timing belt pulley 84 is positively connected to the extended shaft of hydraulic drive motor 72. Second timing belt drive pulley 84 is positively connected through ribbed timing belt 86 to a second driven timing belt pulley 85. A short upper drive shaft 60 connects the second positively driven timing belt pulley 85 to an upper universal joint 88 which is attached at the other end to an upper extension shaft 116. Shaft 60 is protected by a clamp block 56. Similarly the upper universal joint 88 is protected by a guard 62.

Air supplied through flexible supply hose 25 is connected to the external air line connector 132. A clamping bolt and bracket unit 124 support the external air line connector 132 and the hard, inflexible air supply tube 123. An upper pipe weldment 122 holds the rigid air supply tube 123 in place.

Figure 5A:
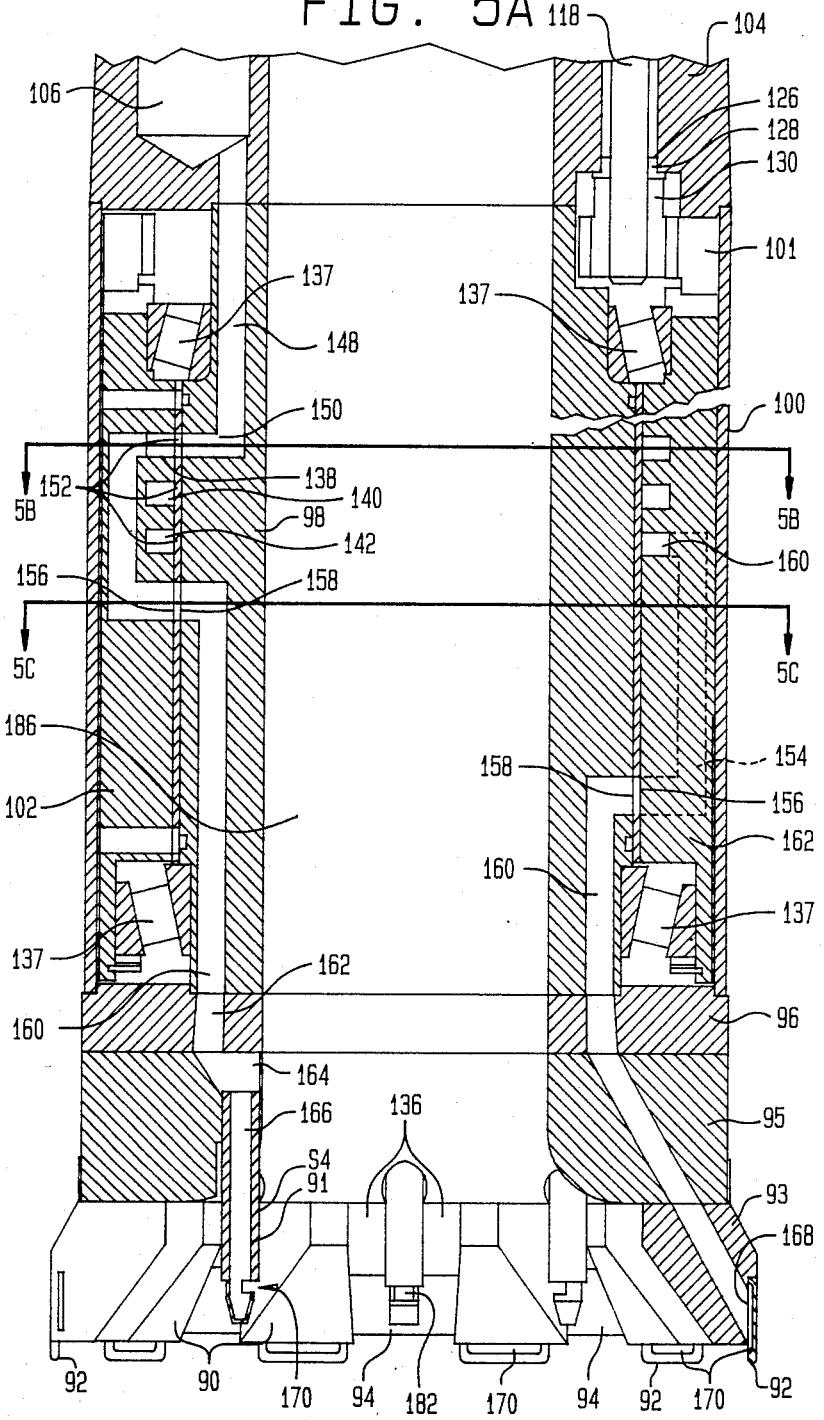
FIG. 5A is a vertical cross-sectional detail view of the digging head and air distributor mechanism.
Figure 5C:
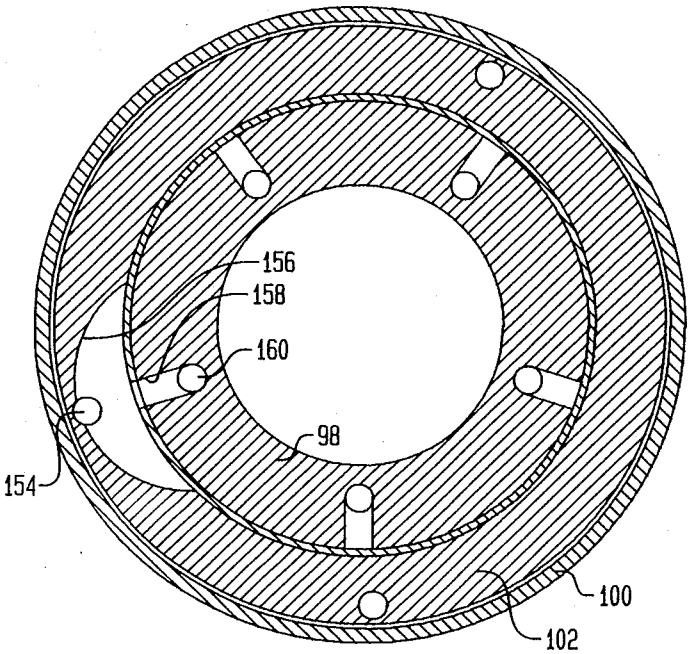
FIG. 5C is another cross-sectional view of the air distributor unit shown in FIG. 5A as seen from perspective 5C—5C.
Figure 5B:
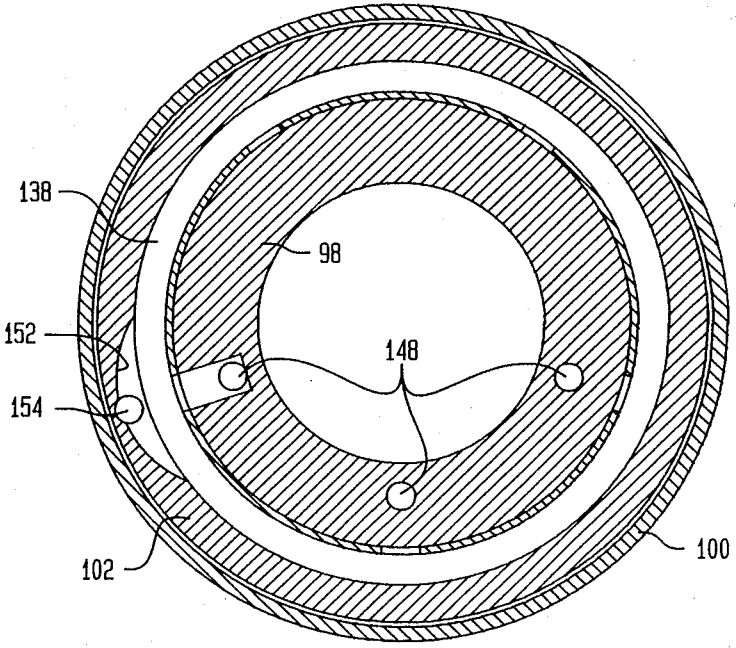
FIG. 5B is a cross-sectional view of the air distributor unit shown in FIG. 5A as seen from perspective 5B—5B.

The digging head unit or mouth 38 of penetrator 10 is shown in vertical cross-sectional detail in FIG. 5A. FIG. 5B is a cross-sectional detail of the digging head 38 as shown through section 5B—5B of FIG. 5A. Similarly, FIG. 5C is a cross-sectional detail of the digging head 38 as seen through section 5C—5C of FIG. 5A. According to the preferred embodiment 10 the digging head section 38 includes ten external peripheral air lances 90 identified as L1 through L10 and five internal air lances 91 identified as S1 through S5. Each of the external air lances 90 includes a block 93 and a tooth plate 92 which serves the dual function of acting as the penetrating edge for the digging head 38 and directing the air blasts inwardly. There is also a hole sizing plate between adjacent block 93 for removing earth. Block section 93 which mounts to intermediate section 95 acts as a mounting surface for tooth plate 92. Intermediate section 95 serves as a mounting platform for the internal 91 and external 90 air lances and a retainer section 96 connects the intermediate section 95 to the upper portion of the earth penetrator 10.

The primary components of the air distributor section 39 are a stationary internal stator 98 and a rotatable rotor 102 which surrounds the stator 98. Distributor sleeve 100 surrounds and protects the rotor 102. Internal rotor gear 101 is rigidly connected to rotor 102. Rotor gear 101 meshes with spur or pinion gear 130 which is positively connected through a drive train to hydraulic motor 72. Spur gear 130 is supported by bushing 128 and connected by extension shaft 118 to a lower universal joint 120. Lower universal joint 120 is directly connected by upper extension shaft 116 to the upper universal joint 88. Upper extension shaft 116 is protected by weldment 114 on the upper penetrator extension sleeve 172. Upper penetrator extension sleeve 172 is connected to a lower penetrator extension sleeve 174 which houses internal air passageway section 144. Lower extension sleeve 174 is in turn connected to orifice section 110 which houses charge nozzle 112 and includes an extension air passagewav 146. Orifice section 110 is in turn connected to the air reservoir block section 104 which houses three internal air reservoirs 106. Air reservoir block section 104 also houses extension shaft 118 as previously described. Air distributor section 39 is connected above to the air reservoir block section 104 and below by retainer section 96 and mounting block 95 to the external air lances 90 and the internal air lances 91. The ten external air lances 90, their associated digging teeth 92 and hole sizing plate 94 are mounted on block 93 which is rigidly attached to the mounting block 95 which also contains the internal air lances 91. Block 93 and the hole sizing plates 94 define ten passages 136 which allow ambient air from outside of the digging head section 38 to enter the evacuated interior passageway 186 at air velocities high enough to entrain solid particles up to 2–3 inches maximum.

Rotor 102 is supported by upper and lower tapered roller bearings 137 and includes three circular grooves or decks 138, 140 and 142 respectively for distributing air to the air lances 90 and 91. Air is supplied from compressor 32 and through flexible air supply line 25 to the inflexible air supply tube 123 and through passageway 144 to charge nozzle 112. There are three charge nozzles 112 each connected by a separate air passageway 146 to one of the three air reservoirs 106. The purpose of the three charge nozzles 112 is to meter the air into the three air reservoirs 106. It is important that the charge of air supplied to the air lances 90 and 91 be substantially uniform in pressure and volume from air lance to air lance. This is best assured by isolating the air reservoirs 106 one from another, so that discharge of one reservoir 106 has essentially no effect on the other two reservoirs 106 and each reservoir 106 will be refilled before it is required to be "fired" again. It may be noted that the peak value of air flow can be much higher than the average value of air flow, when the isolated reservoirs 106 are used. Each of the three air reservoirs 106 is connected by an intermediate passageway 148 to one of three upper ports 150 in stator 98. Each of the three upper stator ports 150 can line up against one of five upper rotor oorts 152. Since there are three rotor decks 138, 140 and 142 and five upper rotor ports 152 per deck, there are a total of fifteen upper rotor ports 152 in all. The fifteen upper rotor ports 152 are connected by three intermediate air passageways 154 to three lower rotor ports 156. Each of the three lower ports 156 can line up with one of five lower stator ports 158. Each of the fifteen lower stator ports 158 is connected by air passageways 160, 162, 164, and 166 to an air lance discharge nozzle 170.

The air passageway mechanism just described relates to internal air lance S4. In general according to the preferred embodiment most of the air passageways do not line up verticallv directly above one another as shown for air lance S4 in FIG. 5A, but rather tend to be offset as shown by the diagramatic description of the air passageway for the external air lance L3 in FIG. 5A. The air passageway scheme for typical air lance L3 shown on the right hand side of FIG. 5A is virtually identical to the scheme previously described for distributing air to internal air lance S4. The only significant difference is that passageway 154 associated with external air lance L3 is shown in phantom line to indicate that there is an offset between the alignment of the lower stator discharge port 158 and the upper rotor port 152. The structure of the external air lances 90 is such that the digging teeth 92 include an internal air passageway 168 which directs the air lance nozzle 170 inwardly.

FIG. 5B illustrates in a cross-sectional view the manner in which the three air reservoirs 106 feed the upper rotor ports 152. As previouslv described each of the three air passageways 148 feed one of three upper stator ports 150. The five upper rotor ports 152 per deck line up across from one of the three upper stator ports 150 once per revolution of the rotor 102 around stator 98. This causes air to discharge from one of the three air reservoirs 106 across an upper stator port 150 into deck 138 through an upper rotor port 152 and into passageway 154. The upper rotor ports 152 have a partially semi-circular or scalloped shape so as to give the air reservoir 106 sufficient time and flow area to discharge air to the lances 90 or 91 at a high flow rate. The lower rotor discharge ports 156 also have a partially semi-circular or scalloped shape in order to provide sufficient time and area for the air to flow from passageway 154 through lower rotor port 156 into the lower stator port 158 and through passageway 160 to an internal air lance 91. It is useful to note that the lefthand alignment of the internal air passageways shown in FIGS. 5A, 5B and 5C are somewhat unusual in that they are all directly one above the other. This is only the case for internal air lance S4. In all other cases the air passageways are staggered as shown for the case of external air lance L3 on the right hand side of FIG. 5A.

Figure 5D:
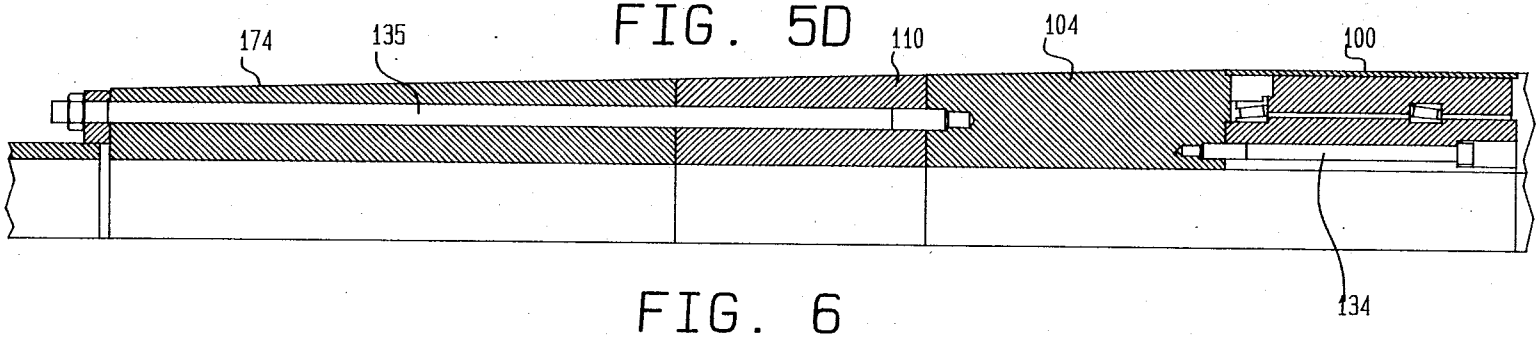
FIG. 5D is a partial vertical cross-sectional view of the digging head and air penetrator sections shown in FIG. 5A illustrating the location of tie-bolts holding the unit together.

FIG. 5D illustrates the manner in which the sections of the air distributor 39 and digging head 38 are connected together. A relatively long tie bolt 135 passes through sections 104, 110 and 174 and holds them together. Similarly, bolt 134 connects section 104 to air reservoir section 39.

Figure 6:
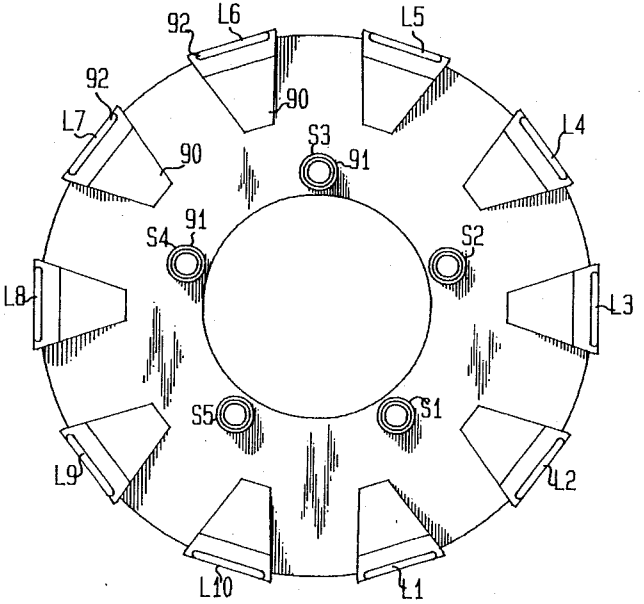
FIG. 6 is a bottom plan view of the penetrator head showing the location of the internal and external air lances.

FIG. 6 is a bottom plan view of the air distributor and digging head arrangement illustrated in FIG. 5A. The ten external air lances L1 through L10 are shown located around the periphery of the digging head section 38. Internal air lances S1 through S5 are located at regular intervals between the external air lances L1 through L10. The ten external air lances L1 through L10 are located at equal intervals spaced 36° apart. Similarly, internal air lances S1 through S5 are located 72° apart. The fifteen air lances 90 and 91 are divided into three groups of five each. The first set of air lances 180 comprises the five internal air lances S1 through S5 which are fed through the first rotor deck 138. The second set of air lances 172 comprises external air lances L2, L4, L6, L8 and L10 which are fed through the intermediate rotor deck 140. The third set of air lances 176 comprises the remaining external air lances L1, L3, L5, L7 and L9 which are fed through the third rotor deck 142. The construction of the internal air lances S1 through S5 is different from the construction of the external air lances L1 through L10. Internal air lances S1 through S5 comprise tubes with a taper-lock fit for attachment to mounting block section 95. The other end of the internal air lances 91 comprises a discharge air nozzle 170. Internal air nozzles 170 preferably point inward for normal excavation, but may be directed in a variety of different angles in order to expedite the removal of clogging material from the inside of the digging head unit 38. The external air lances 90 have a relatively flat construction which is limited by the geometry of the digging plate 92. The primary purpose of the external air lances L1 through L10 is to dislodge dirt and force it inwardly so that the suction in the inner passageway 186 can remove the loosened debris. While the inner air lances S1 through S5 also serve to remove dirt and debris, their primary purpose is to keep the interior passageway 186 from becoming clogged and to further assist in the lifting function. Ambient air drawn through passageways 136 assists in the lifting function by providing a fluid behind the dirt and debris dislodged by air lances S1 through S5 and L1 through L10. Therefore the shape of the discharge orifice 182 for the inner air lances S1 through S5 is smaller and more pinpointed than the broader discharge orifices 184 for the outer air lances L1 through L10.

Figure 7A:
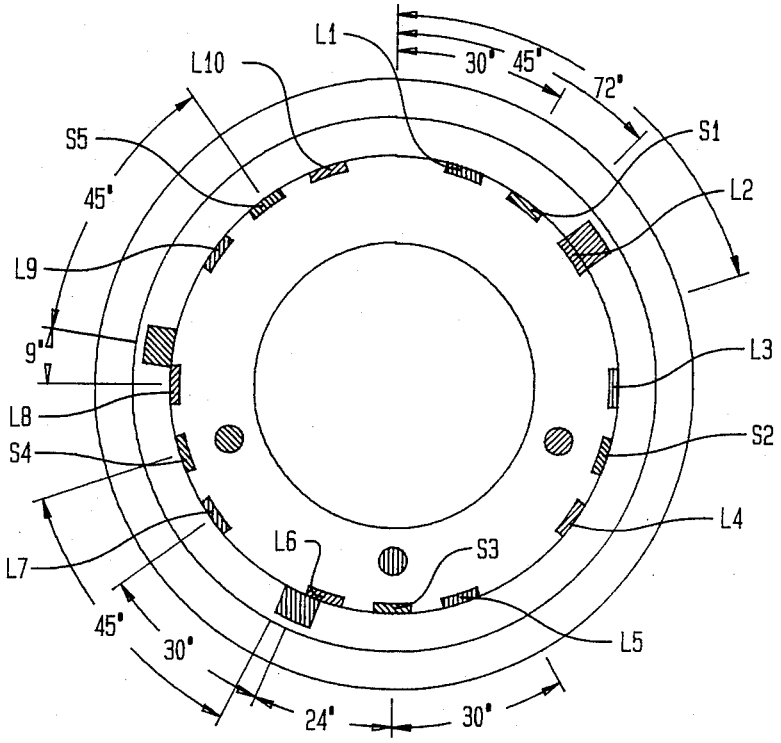
FIG. 7A is schematic diagram showing the groupings of related air lances.
Figure 7D:
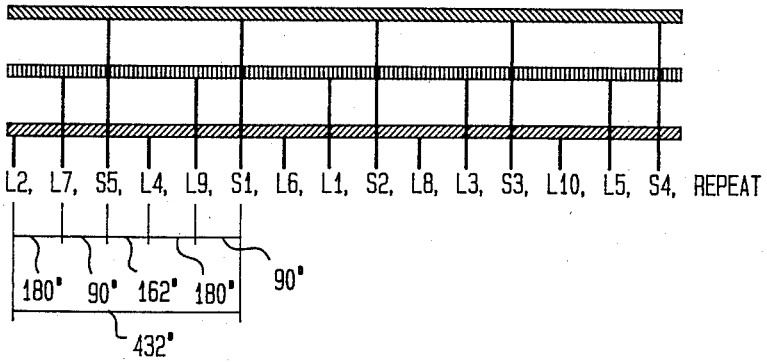
FIG. 7D a table illustrating the firing sequence of the air illustrated in FIGS. 6 and 7A.
Figure 7B:
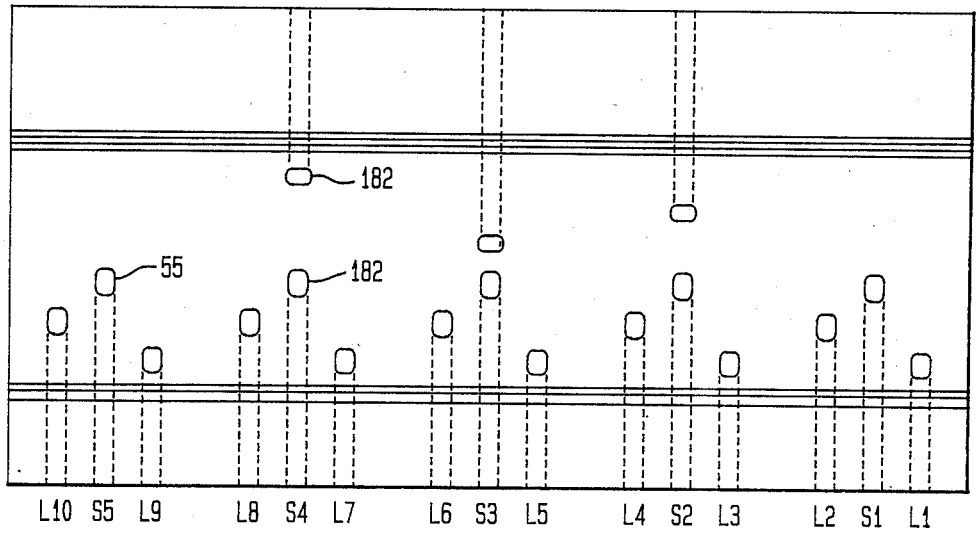
FIG. 7B is an unfolded vertical elevational view of the stator showing the porting arrangement thereof.
Figure 7C:
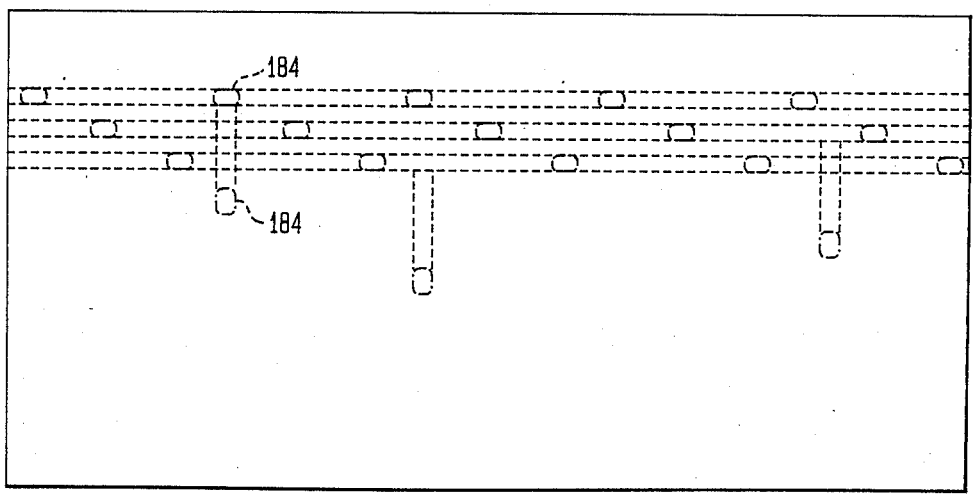
FIG. 7C an unfolded vertical elevational view of the three rotor decks showing the porting arrangements thereof.

The method of sequencing the air blasts from the air lances 90 and 91 and synchronizing that with the rotation of the eccentric mass 50 is illustrated in FIGS. 7A through 7D. FIG. 7A is a hypothetical cross-sectional view showing the porting arrangements for air lances S1 through S5 and L1 through L10 as seen from above the air distributor section 39. FIGS. 7B and 7C are vertical elevations of the stator 98 and the rotor 102 respectively as though they were cut vertically and unwrapped. When the rotor porting arrangement shown in FIG. 7C passes the stator ports shown in FIG. 7B it produces the air blast sequence illustrated in Table 7D. There are several important things to note from Table 7D. First, the eccentric mass 50 preferably rotates six times before the same air lance fires for a second time. This allows an individual air lance at least six oscillations to dig itself deeper into the dirt before the next firing event with this lance. Within limits, the deeper an external air lance L1 through L10 is dug into the dirt, the better. The lance firing arrangement is structured to avoid sequential firing of adjacent lances 90. This was done in response to the observation that air leak paths may be generated as a small trench that reaches to an adjacent lance 90. The trench would constitute a leak path for the adjacent lance 90 if it were fired sequentially. Tests of a "criss-cross" lance firing pattern showed that such leak paths were markedly reduced. This should occur because of the added number of orbital cycles that advance the penetration so that the former leak path is by-passed by the soil penetrated. This was confirmed both bv direct observation of the dirt surface and by improved penetration (digging) rates. The purpose of the external air lances L1 through L10 is to blow the dirt towards the center passagewav 186 of the penetrator 10. If an external air lance L1 through L10 is not seated deeply into the dirt it will merelv discharge air and produce no effect. Second, no individual air lance S1 through S5 or L1 through L10 will fire unless and until the heaviest part 51 of the eccentric mass 50 is located directly above that air lance. It is important for the heaviest part 51 of the eccentric mass 50 to be above the air lance being fired so that that particular air lance is most deeply embedded into the earth at the time of firing. Third, it will be noted that the lances fire in a staggered, or criss-cross fashion. It is generallv not desirable to have closely spaced air lances fire in a circular pattern since the cavity formed by one air lance may directly affect the seal made between the earth and the air lance of its next neighbor. Therefore the lances are fired in a staggered, or criss-crossed fashion so as to maximize the ability of each individual air lance to dig deeper into the earth and form an air seal with the earth directly prior to firing. If a good air seal between the air lance and the earth is not formed, the air lance looses substantial efficiency because it is merely venting air rather than blowing dirt. As shown in FIG. 7D internal air lance L7 fires after 180° rotation of eccentric mass 50 after the firing of external air lance L2. Internal air lance S5 then fires after another 90° of rotation of eccentric mass 50 after the firing of external air lance L7. Then external air lance L4 fires after 162° of rotation of eccentric mass 50 after the firing of internal air lance S5. Then the sequence begins again with external air lance L9 firing after 180° of rotation of eccentric mass 50 after the firing of air lance L4. Note that external air lance L4 fires after 432° of rotation of eccentric mass 50 after the firing of external air lance L2. In other words the eccentric mass 50 rotates 432°, or one and one-fifth rotations, after the last firing of an air lance in that group. Since there are a total of five air lances in any particular group it is seen that the eccentric mass 50 travels six complete rotations before any given air lance in that group fires for a second time (i.e. five times 432° equals six complete rotations). It is possible to achieve this precise synchronization between the rotation of the eccentric mass 50 and the discharge of the air lances S1 through S5 and L1 through L10 because eccentric mass 50 and the air distributor 39 are both directly and positively driven by the same hydraulic motor 72.

Figure 8B:
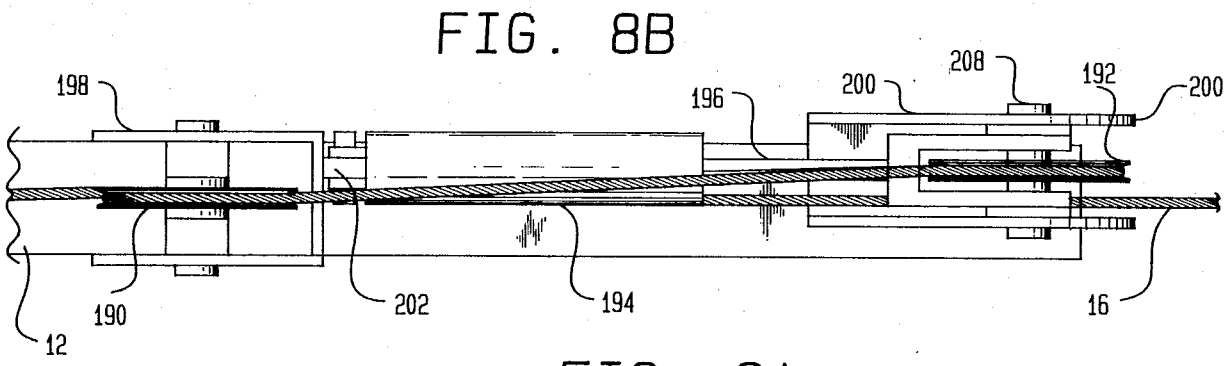
FIG. 8B is a top plan view of the cable tensioning mechanism of FIG. 8A.
Figure 8A:
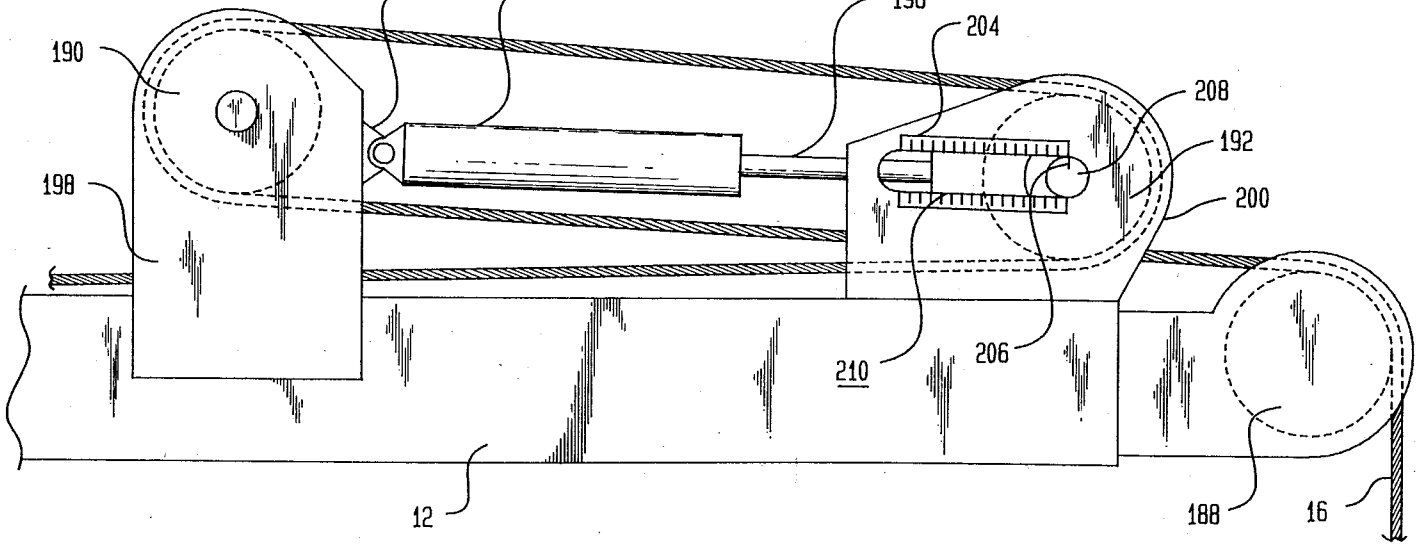
FIG. 8A is a vertical detailed view of the cable tensioning mechanism.

The primary purpose of the invention is to be able to rapidly dig a hole into the earth without exerting so much downward pressure that underground utilities are damaged. In order to assist in this function the invention includes the use of an automatic tensioning mechanism 18 which supplies enough upward tension on cable 16 to keep the earth penetrator 10 in an upright position and further, to support the weight of the excavator 10 at the lowest value of tension that can be applied to maintain the correct position and attitude needed for digging. According to the preferred embodiment of the invention the earth penetrator 10 weighs approximately 600 lbs. and the tensioning mechanism provides an upward force of between 100 and 200 lbs., to keep the penetrator 10 vertical. The exact amount of tension applied by the tensioning mechanism 18 will be varied to optimize it according to soil conditions and air pressures available. Tensioning mechanism 18 is supported by boom 12. Cable 16 passes over boom pulley 188 and around a first tensioning pulley 190, and around a second tensioning pulley 192 to the cable take up mechanism 20. Hydraulic cylinder 194 controls the force or tension between pulleys 190 and 192. Hydraulic cylinder rod 196 pushes against the second tensioning pulley 192 causing it to move forward or backward. The first tensioning pulley 190 is supported by a bracket 198. Similarly, the second tensioning pulley 192 is supported by bracket 200. One end of hydraulic cylinder 194 is rigidly, but pivotally attached by a mounting block 202 to support bracket 198 of pulley 190. The other end of hydraulic cylinder 194 is attached through rod 196 to a sliding block 208 connected directly to the second pulley 192. Sliding block 208 and pulley 192 are free to slide along the length of slot 210 in pulley bracket 200 under the influence of hydraulic cylinder 194. Scale 204 is located on opposite sides of slot 210 to measure the travel of pulley 192. A witness mark 206 located on sliding block 208 indicates that location of the pulley 192 with respect to scale 204 at any given time. In the preferred embodiment the stroke or travel of pulley 192 is approximately 12", which is slightly shorter than the length of slot 210. Cable 16 preferably comprises a 5/16" diameter 7–19 corrosion resistant wire rope. FIG. 8A shows the tensioning mechanism in a vertical elevational view, whereas FIG. 8B shows the same mechanism in a top plan view.

Figure 9:
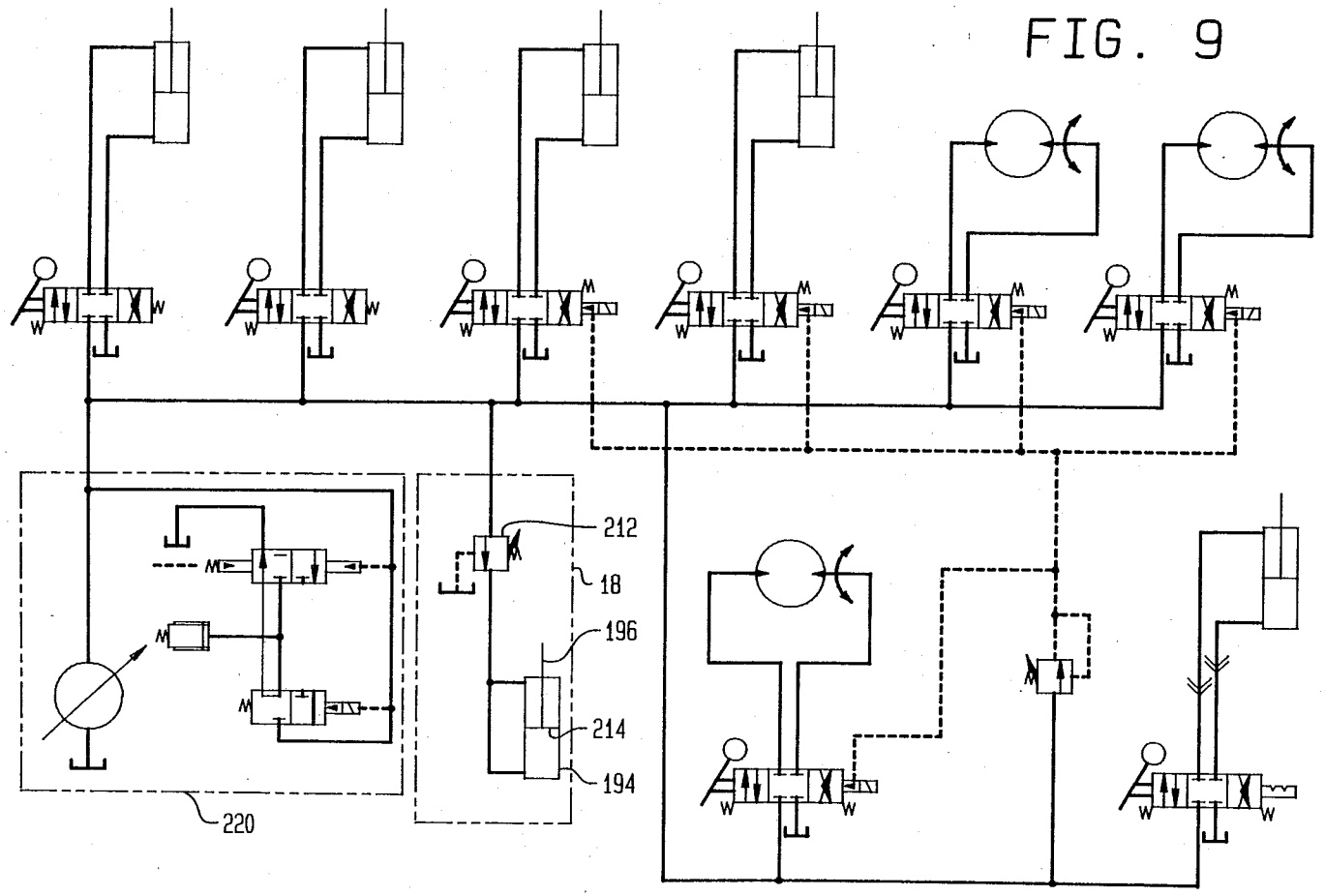
FIG. 9 is a hydraulic schematic of the cable tensioning mechanism and other related elements of the earth penetrator invention.

The hydraulic schematic for the main elements of the invention 10 is illustrated in FIG. 9. One of the three conventional hydraulic pumps provides power to a variety of the hydraulic subsystems, including the down force tensioning mechanism 18, the crane cable wench mechanism 20, the dump mechanism for the vacuum cyclone recovery unit 24, the crane rotation mechanism, the excavation rotation mechanism, the crane extension mechanism, the crane lift mechanism, the right outrigger and the left outrigger. Hydraulic power to the tensioning mechanism 18 is controlled by a manually operable pressure relief valve 212. Fluid from pressure relief valve 212 is applied to both ends of hydraulic cylinder 194. The pressure applied to both ends is the same. However, due to the internal area taken up by hydraulic cylinder rod 196, the net force applied to both sides of the hydraulic piston diaphragm 214 is not the same. This is because the surface on the rod side of diaphragm 214 is smaller than the surface on the other side of piston diaphragm 214. This causes a net outward force on rod 196 which is directly proportional to the pressure supplied through relief valve 212. Therefore the crane operator can increase the upward force on cable 16 and on earth penetrator 10 by manually increasing the amount of hydraulic fluid pressure through pressure relief valve 212. Conversely, the operator can decrease the amount of upward force on earth penetrator 10 by manually decreasing the setting of pressure relief valve 212. In operation the crane operator will manually determine the best pressure and then set the witness mark 206 and attempt to keep it within the 12 inch stroke available. Too little or too much tension will cause the tension 94 to exert more of less take-up or payout. Optimally the length of the distance of the cable 16 from the boom pulley 188 to the ring 42 on the top of penetrator 10 is not more than 12". Generally the longer the distance between the boom pulley 188 and the ring 42, the more tension has to be applied to cable 16 to keep the penetrator 10 upright. This is because the cable 16 forms the hypoteneuse of a triangle and the shorter the hypoteneuse the shorter the righting moment necessary to keep the penetrator substantially vertical.

In operation, the field crew will typically drive the truck 14 to the location of a scheduled installation maintenance or repair or to suspected underground utility fault. At that location the driver will disconnect the wheels from the transmission and connect the output of the 175 hp diesel engine directly to the conventional hydraulic pump schematically shown in FIG. 9, through a split-shaft tranmission mechanism. The operator then connects the cable hook 44 to the ring 42 on the top of penetrator 10. The boom 12 and cable 16 are operated to remove the penetrator 10 from the travelling socket 45 and place it in position near the area where the utilities are thought to be located. The operator then checks all of the systems to make sure that the vacuum is being applied through vacuum line 22, that compressed air is available over flexible air supply line 25 and that hydraulic fluid is being supplied through hydraulic line 26 to hydraulic motor 72. At this point, the operator taking into account his experience, the hardness of the earth and available air and hydraulic pressures will set up the excavator 10 for maximum downward digging efficiency. First, the operator lifts the excavator 10 and spots it over the location where the hole 40 is to be dug. Second, the "up" force is set by adjusting the flow-compensated pressure reducing relief valve 212 which supplies hydraulic fluid to tensioning cylinder 194. Third, the excavator 10 is lowered to the ground while being maintained in a vertical attitude. The lowering maneuver transfers load from the crane boom 12 to the ground. As soon as the desired down force is reached, the constant-tension cylinder 194 will take up the cable 16. Fourth, as digging with the excavator 10 proceeds, the crane operator can monitor the exact progress of the hole digging by watching the movement of the witness mark 206 connected to sliding pulley block 208. The cable 16 continues to be taken up as the lowering process progresses until the full stroke of the constant tension cylinder 194 is reached. Fifth, when the tensioning cylinder 194 approaches its limit of 12" payout, the operator must readjust the boom 12 by using the cable take-up reel 20 of the crane winch. As before, the constant tension cylinder 194 will take up the line paid out and will be in a position to feed cable as the digging proceeds.

During the digging operation hydraulic motor 72 causes eccentric mass 50 to rotate thereby oscillating the penetrator 10 in synchronism with the air blasts from lances S1 through S5 and L1 through L10 as controlled by air distributor section 39. The synchronizing and sequencing of eccentric mass 50 with respect to the individual air lances S1 through S5 and L1 through L10 was described in detail with respect to FIGS. 7A through 7D. Each time an air lance S1 through S5 or L1 through L10 fires it dislodges dirt which is sucked up through passageway 186 and through vacuum line 22 into the vacuum earth recovery cyclone 24. Continued rotation of eccentric mass 50 and firing of air lances S1 through S5 and L1 through L10 causes the penetrator head 38 to dig progressively deeper into the ground until it comes into contact with a hard object such as an underground utility line. The penetrator 10 does not rotate, it merely oscillates. Because it cannot exert a downward force of more than 400 or 500 lbs., it is virtually impossible for it to damage a typical underground utility which is generally designed to withstand at least 400 or 500 lbs. force. If the operator chooses, he can dig more than one hole 40 by repeating the procedure just described in order to form a trench or hole of any configuration. If a large amount of dirt is removed from hole 40 it may be necessary to interrupt operation from time to time and empty the vacuum cyclone separator 24. Vacuum cyclone separator 24 is emptied by picking it up by a hook on the top thereof, lifting the separator 24 over a discharge area and releasing a hydraulic dump mechanism at the bottom thereof.

The invention has been described with respect to a preferred embodiment including fifteen air lances. A greater or lesser number of air lances could be employed depending upon factors such as the size of the hole to be dug, available air and hydraulic pressures, soil conditions, etc. For example, if the hole is to be very small, there may not be room for internal air lances and therefore only exterior air lances might be required. So, if fewer air lances are used it may not be necessary to stagger the firing of the air lances since one air lance may not have a major effect upon its neighbor under such circumstance. The weight of the earth penetrator 10 has been described as being approximately 600 lbs. with the net downward force being between 400 and 500 lbs. as controlled by the tensioning mechanism 18. Although 600 lbs. gross weight for the earth penetrator is the preferred weight, it will be appreciated that weights more or less than 600 lbs. could be quite as acceptable. It is likely that an earth penetrator 10 having a smaller mouth 38 would probably have a correspondingly lower weight. The tensioning mechanism 18 makes it easier for the equipment operator to efficiently dig a hole 40. However, the tensioning mechanism 18 is not absolutely necessary if the equipment operator is willing to put up with less than optimal performance. Also the amount of tension applied to cable 16 will vary depending upon air and hydraulic pressures, operator judgment and the nature and condition of the soil. Therefore, it is not necessary that the upward tension be between 100 and 200 lbs. It could be more or less depending upon the particular circumstances.

While the invention has been described with reference to a preferred embodiment thereof, it will be appreciated by those of ordinary skill in the art that modifications can be made to the function and structure of the invention without departing from the spirit and scope thereof.

We claim:

1. An earth penetrating apparatus comprising:
a tube having a top end and a bottom end and an internal passageway communicating said top end with said bottom end;
a plurality of nozzle means located at the bottom end of said tube;
a source of high pressure air;
distributor means for distributing said high pressure air to selected nozzle means in a predetermined pattern;
oscillating means attached to said tube to cause said apparatus to oscillate;
a motor means for driving said oscillating means and said air distributor means in synchronism with each other; and,
tensioning means attached to said apparatus to control the ent downward force of said tube.

2. The apparatus of claim 1 wherein said oscillating means comprises an eccentrically mounted weight rotatably attached to said apparatus.

3. An earth penetrating apparatus comprising:
a tube having a top end and a bottom end and an internal passageway communicating said top end with said bottom end;
a plurality of nozzle means located at the bottom end of said tube;
a source of high pressure air;
distributor means for distributing said high pressure air to selected nozzle means in a predetermined pattern;
oscillating means attached to said tube to cause said apparatus to oscillate, said oscillating means includes an eccentrically mounted weight rotatably attached to said apparatus;
tensioning means attached to said apparatus to control the net downward force of said tube; and
a motor means for driving said oscillating means and said air distributor means in synchronism with each other.

4. The apparatus of claim 3 wherein said apparatus further comprises:
a first direct drive means for positively connecting said motor means to said oscillating means; and,
a second direct drive means for positively connecting said motor means to said air distributor means.

5. The apparatus of claim 4 wherein said air distributor means comprises:
at least a first and a second air reservoir means; and,
at least a first and a second circular deck means connected to said second direct drive means for discharging air to selected nozzle means in at least two separate groups of nozzle means.

6. The apparatus of claim 5 wherein said plurality of nozzle means comprises:
at least a first inner group of nozzle means located inside the periphery of the bottom end of said tube and fed by said first air reservoir means; and,
at least a first group of outer nozzle means located at the periphery of the bottom end of said tube and fed by said second air reservoir means.

7. The apparatus of claim 6 wherein said plurality of nozzle means further comprises:
a second group of outer nozzle means fed by a third air reservoir means.

8. The apparatus of claim 7 further comprising:
a vacuum source; and,
hose means connecting the top of said internal passageway with said vacuum source so as to produce a vacuum at the bottom end of said tube.

9. The apparatus of claim 8 wherein said motor means comprises an hydraulic motor.

10. The apparatus of claim 9 further comprising:
a source of pressurized hydraulic fluid; and,
hydraulic hose means for connecting said source of pressurized hydraulic fluid to said motor means.

11. The apparatus of claim 10 further comprising:
a cable attachable to said tube;
a cable take-up mechanism for winding and unwinding said cable; and,
a movable boom for supporting said cable.

12. The apparatus of claim 11 wherein said tensioning means is attached to said boom, said tensioning means comprising:
a first non-movable bracket attached to said boom;
a first rotatable pulley mounted on said first bracket;
a second bracket mounted on said boom and having a slot therein;
a second pulley mounted in the slot of said second bracket so that said second pulley can travel along the length of said slot;
an hydraulic cylinder having one end thereof connected to said boom and the other end thereof connected to said second pulley; and,
hose means for connecting said source of pressurized hydraulic fluid to said hydraulic cylinder,
wherein said cable is wrapped around said first and second pulley in such a manner that the application of hydraulic fluid to said hydraulic cylinder causes said second pulley to move away from said first pulley thereby increasing the tension on said cable and increasing the upward lifting force on said tube.

13. The apparatus of claim 12 wherein said hydraulic cylinder further includes:
an internal diaphragm; and,
a rod connected to one side of said internal diaphragm and movable under the influence of said pressurized hydraulic fluid.

14. The apparatus of claim 13 wherein said tensioning means further comprises:
a pressure relief valve fed by said source of pressurized hydraulic fluid; and,
two hydraulic lines extending from said pressure relief valve to said hydraulic cylinder and terminating on the inside of said cylinder on opposite sides of said internal diaphragm,
whereby the hydraulic pressure provided to both sides of said cylinder is equal, but the force exerted on said diaphragm is greater on the side of said diaphragm not connected to said rod.

15. The apparatus of claim 14 wherein said motor means and said first and second direct drive means cause high pressure air to be applied to an air nozzle only when the heaviest part of said eccentrically mounted weight is located directly above a nozzle means being fed with air.

16. The apparatus of claim 15 wherein only one air nozzle fires at one time and wherein the pattern of firing said air nozzles is such that the neighboring air nozzle of any given air nozzle is not the next air nozzle to fire after said given air nozzle has fired.

17. The apparatus of claim 16 where:

said first outer group of air nozzles comprises five air nozzles; and, said second outer group of air nozzles comprises five air nozzles; and, said first inner group of air nozzles comprises five air nozzles.

18. The apparatus of claim 17 wherein said inner air nozzles have a smaller area discharge port than the discharge ports of said outer air nozzles.

19. The apparatus of claim 18 wherein said hydraulic motor is directly connected to a first timing belt and a shaft to said air distributor and wherein said eccentric mass is directly connected to the same hydraulic motor through a second timing belt.

20. An earth penetrating apparatus comprising:

a tube having a top end and a bottom end and an internal passageway communicating said top end with said bottom end;

a source of vacuum connected to said internal passageway;

oscillating means attached to said tube to cause said tube to oscillate, said oscillating means including an eccentrically mounted weight rotatably attached to said tube, said eccentrically mounted weight having a heavy section and a relatively lighter section;

a plurality of nozzle means located at the bottom end of said tube;

a source of high pressure air;

distributor means for distributing high pressure air to selected nozzle means in a predetermined pattern; and, motor means for driving said oscillating means and said air distributor means so that any given nozzle means will discharge high pressure air only when the heavy section of said eccentrically mounted weight is located directly above a discharging nozzle means.

21. The apparatus of claim 20 wherein said distributor means comprises:

a stator means including a plurality of stator parts therein; and, a rotor means driven by said motor means relative to said stator means, said rotor means including a plurality of rotor ports therein, wherein rotation of said rotor means relative to said stator means distributes air through said stator ports and said rotor ports to said nozzle means.

22. The apparatus of claim 21 further including:

a source of pressurized hydraulic fluid; and, hydraulic hose means for connecting said source of pressurized hydraulic fluid to said motor means.

23. The apparatus of claim 22 further including:

a cable attachable to said tube;

a cable take-up mechanism for winding and unwinding said cable; and, a movable boom for supporting said cable.

24. The apparatus of claim 23 further including tensioning means attached to said boom said tensioning means comprising:

a first non-movable bracket attached to said boom;

a first rotatable pulley mounted on said first bracket;

a second bracket mounted on said boom and having a slot therein;

a second pulley mounted in the slot of said second bracket so that said second pully can travel along the length of said slot;

an hydraulic cylinder having one end thereof connected to said boom and the other end thereof connected to said second pulley; and, hose means for connecting said source of pressurized hydraulic fluid to said hydraulic cylinder, wherein said cable is wrapped around said first and second pulley in such a manner that the application of hydraulic fluid to said hydraulic cylinder causes said second pulley to move away from said first pulley thereby increasing the tension on said cable and increasing the upward lifting force on said tube.

25. An earth penetrating apparatus comprising:

a tube having a top end and a bottom end and an internal passageway communicating said top end with said bottom end;

oscillating means attached to said tube to cause said tube to oscillate, said oscillating means including an eccentrically mounted weight rotatably attached to said tube;

said eccentrically mounted weight having a heavy section and a relatively lighter section;

a plurality of nozzle means located at the bottom end of said tube;

a source of high pressure air;

distributor means for distributing high pressure air to selected nozzle means; and, motor means for driving said oscillating means and said air distributor means so that any given nozzle means will discharge high pressure air only when the heavy section of said eccentrically mounted weight is located directly above a discharging nozzle means.

26. An earth penetrating apparatus comprising:

a tube having a top end and a bottom end and an internal passageway communicating said top end with said bottom end;

a source of vacuum connected to said internal passageway;

oscillating means attached to said tube to cause said tube to oscillate;

a plurality of nozzle means located at the bottom end of said tube;

a source of high pressure air;

distributor means for distributing high pressure air to selected nozzle means in a predetermined pattern; and, motor means for driving said oscillating means and said air distributor means so that any given nozzle means will discharge high pressure air only when said oscillating means applies a downward force on said selected nozzle means.

* * * * *